US006041724A

United States Patent [19]

Hung

[11] Patent Number: 6,041,724

[45] Date of Patent: Mar. 28, 2000

[54] TOWER GARBAGE INCINERATOR

[76] Inventor: Ming Chin Hung, No. 54, Lane 30, Sec.1, Kuang Fu Rd., Sanchung Taipei Hsien, Taiwan

[21] Appl. No.: 09/157,505

[22] Filed: Sep. 21, 1998

[51] Int. Cl.[7] ..... F23G 5/00; F23G 5/04; F23G 5/16

[52] U.S. Cl. ..... 110/255; 110/210; 110/227; 110/235; 110/248; 110/251; 110/259; 110/267; 110/233

[58] Field of Search ..... 110/203, 235, 110/243, 244, 224, 227, 248, 251, 252, 255, 256, 259, 267, 315, 327, 328, 346, 101 R, 118, 210, 212, 145, 184, 211, 233

[56] References Cited

U.S. PATENT DOCUMENTS

| | | | |
|---|---|---|---|
| 3,777,676 | 12/1973 | Lagen | 110/8 R |
| 4,201,141 | 5/1980 | Teodorescu et al. | 110/259 |
| 4,395,958 | 8/1983 | Caffyn et al. | 110/246 |
| 4,539,917 | 9/1985 | Mallon et al. | 110/256 |
| 4,582,044 | 4/1986 | Ferguson et al. | 126/289 |
| 5,067,425 | 11/1991 | Sporleder | 114/26 |
| 5,762,006 | 6/1998 | Ubaldi et al. | 110/235 |
| 5,816,795 | 10/1998 | Hansen et al. | 432/14 |

*Primary Examiner*—James C. Yeung
*Assistant Examiner*—Ljiljana V. Ciric
*Attorney, Agent, or Firm*—Rosenberg, Klein & Lee

[57] ABSTRACT

A tower garbage incinerator is provided, consisting of an upper main blast furnace having a zigzag furnace cavity, and a lower accessory burning furnace. When garbage is fed through the inlet of the main blast furnace, the zigzag design of the furnace cavity combined with the hot upwardly flowing gas in the blast furnace, causes the garbage to drop slowly and to burn as it drops, as well. The hot gas tumbles the garbage thoroughly, so that caked garbage is completely dispersed, and thereby increases the burning area of the garbage, so as to greatly improve the burning efficiency thereof. Any residual incompletely burned garbage that drops into the accessory burning furnace is burned therein. The accessory burning furnace increases the temperature of gases entering the blast furnace.

3 Claims, 7 Drawing Sheets

TOWER GARBAGE INCINERATOR

BACKGROUND OF THE INVENTION

1. Field of the Invention

The present invention relates to a tower garbage incinerator, and in particular to a tower garbage incinerator consisting of an upper main blast furnace having a zigzag furnace cavity, a garbage inlet and a waste gas outlet. Both the garbage inlet and the waste gas outlet being provided on the top of the blast furnace. The incinerator also includes a lower accessory burning furnace. The garbage incinerator of the present invention has a high efficiency and needs only a small area.

2. Prior Art

Treating garbage by an incinerator has the advantages of reducing the mass of the waste, making the waste harmless, providing resources, and is the most reliable method of waste disposal.

Most conventional large scale incinerators (about 50–2000 tons/day) comprise mixed burning incinerators of the mechanical furnace hearth type, rotary kiln type incinerator or fluidized bed type incinerators. These three types of incinerators each need a large area of land and have poor burning efficiencies. That is, the amount of garbage incinerated is not proportional to the land area of the facility. Such incinerators always have land requirements of several hectares, which makes searching for land to install an incinerator difficult, or otherwise results in the incinerator being located where the garbage must be transported a long way by a garbage truck.

Further, a common disadvantage of the above-mentioned incinerators is that they require too many mechanical operations for tumbling and/or stirring garbage to improve the burning thereof, has too high a probability of breakdown, and has high costs associated with maintenance and operation thereof. For example, in the mixed burning incinerator of the mechanical furnace hearth type, in order to tumble garbage, the furnace hearth tends to become blocked, has a large amount of dead space for tumbling garbage, and the temperature at the furnace floor cannot be elevated (otherwise, the mechanical furnace hearth will be damaged by overheating). Plastic garbage tends to stick to mechanical parts, and/or the furnace hearth might be overheated to result in irreparable damage thereto.

As for the rotary kiln type incinerator, the refractory lining on the inner furnace wall tends to produce fly ash during rotation, and also has a relatively high wear rate and high maintenance cost, as well as being troublesome in the treatment of joining gaps and providing for a gas-proof seal.

As for the fluidized bed type incinerator, garbage should be crushed previously to a size below 5 mm by a crusher. The operation of a crusher is complicated, has much noise, and wears greatly. Moreover, the fluidized bed requires high power and when operated, contaminants such as sodium, lead, borax and the like in the garbages may impair the heat resistance temperature of silica sand fo the fluidized bed (for example, forming viscous sodium silicate glass which may lower drastically fluidizing or form cakes). Therefore, the fluidized bed type incinerator is not commonly used.

In view of overcoming the disadvantages associated with the prior art garbage incinerator, there is a need for a new garbage incinerator which needs only a small area of land to dispose of a great amount of garbage, such that the land for the installation is easy to obtain. The incinerator might then be built near the site of garbage sources.

SUMMARY OF THE INVENTION

Accordingly, the invention relates to a tower garbage incinerator, and in particular to a tower garbage incinerator consisting of an upper main blast furnace having a zigzag furnace cavity, a garbage inlet and a waste gas outlet, both provided on the top of said blast furnace, and a lower accessory burning furnace. The garbage incinerator having high efficiency and requires a small area.

BRIEF DESCRIPTION OF THE DRAWINGS

The invention, as well as its many advantages, may be further understood by the following detailed description and drawings in which.

DETAILED DESCRIPTION OF THE PREFERRED EMBODIMENT

The tower of garbage incinerator consists of an upper main blast furnace having a zigzag furnace cavity, a garbage inlet and a waste gas outlet, both provided on the top of said blast furnace, and a lower accessory burning furnace. Wherein, as explained hereinafter, the main blast furnace can achieve an extremely high burning efficiency by employing thoroughly natural physical principles, without mechanically tumbling garbage. Since the main furnace in the tower of garbage incinerator of the instant invention is a blast furnace having a wide and flat shape, and the inner furnace cavity thereof is designed to be a zigzag pathway, garbage at the inlet provided on the top of the blast furnace can be dried at first by the spent heat rising upwardly along the furnace cavity. The garbage will then drop by the force of gravity. However, the garbage will not drop rapidly nor directly down to the furnace floor due to the zigzag design of the furnace cavity. Such zigzag design of the furnace cavity can sustain the burning of garbage for a long period of time. The natural energy associated with the hot gas flowing upwardly in the blast furnace, can lead garbage to drop slowly and to burn as it drops so that the burning garbage becomes smaller and lighter. Such phenomena where the garbage burns as it drops while hot gases ascend upwardly against the dropping of garbage causes the garbage to be tumbled throughly, so that caked gabage is dispersed completely, and therby increase the burning area to extremely improve the burning efficiency. Furthermore, the blast furnace of the tower garbage incinerator is constructed with acid and heat resistant, strong materials such as alumina ($Al_2O_3$), silicon carbide (SiC), sillicon nitride ($Si_3N_4$), magnessium oxide (MgO) and the like, so that the blast furnace can tolerate the maximum high temperature generated by the burning of metropolitan garbage. Moreover, due to the absence of any furnace hearth in the center of the burning area within the main blast furnace of the tower garbage incinerator, the heat effect therein can be raised as much as possible and operations can be run at a temperature of higher than 1500° C. Owing to the extremely high temperature, the burning speed is increased greatly, and the incineration rate per unit area within the zigzag blast furnace is very high.

In addition, in the tower garbage incinerator of the instant invention, there is also an accessory burning furnace provided beneath the bottom of the zigzag blast furnace. The accessory burning furnace is used mainly for burning spherically shaped garbage that has dropped therein or garbage burned incompletely. Heat generated by completely burning such garbage in the accessory burning furnace can increase the temperature of gases entering the zigzag blast furnace.

Figure 1:
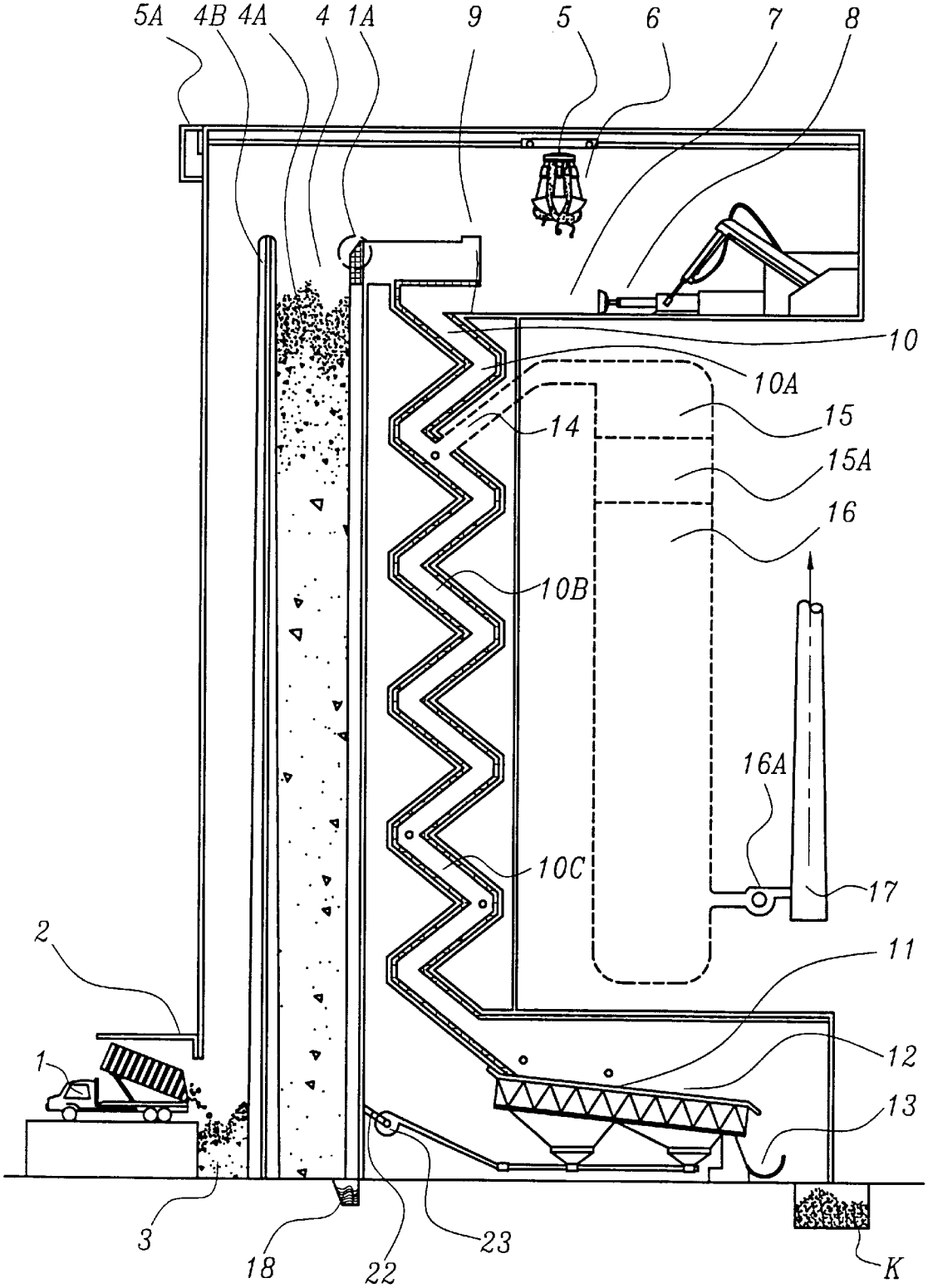
FIG. 1 schematically shows the structure and the illustrative flow scheme of one embodiment of the tower garbage incinerator of the present invention.
Figure 1A:
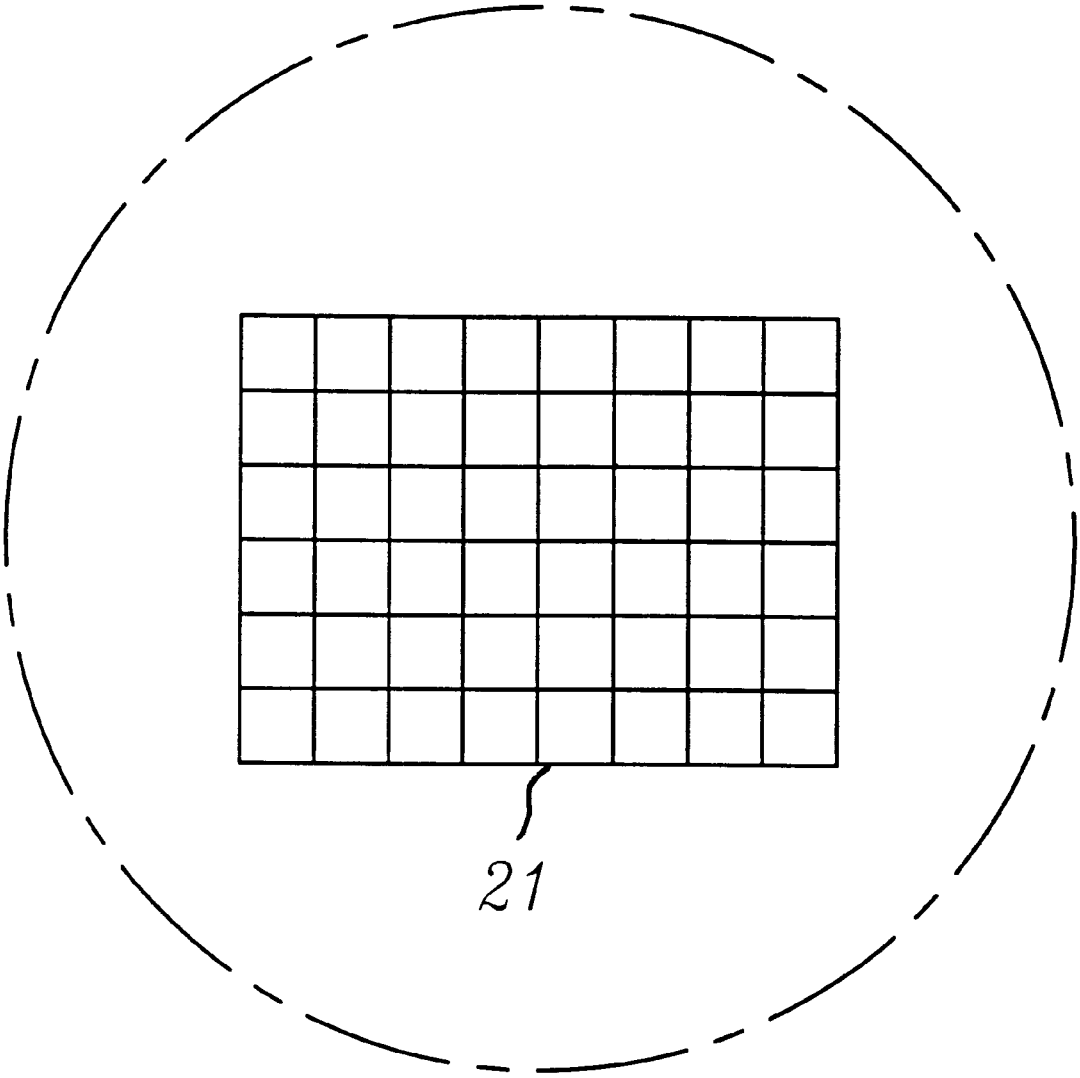
FIG. 1A is an enlarged view of the suction inlet for the tower garbage incinerator of the present invention.

As shown in FIG. 1, the tower garbage incinerator comprises a main structure as follows: a zigzag blast furnace 10 is provided on the upper part of the tower garbage incinerator as the main furnace and is constructed with acid and heat resistant, strong materials such as alumina ($Al_2O_3$), silicon carbide (SiC), silicon nitride ($Si_3N_4$), magnessium oxide (MgO) and the like. At the lower part of the tower garbage incinerator there is provided an accessory burning furnace 12. A large garbage pit 4, which can accommodate a large amount of garbage, is established, with a high wall 4B constructed of steel rod and concrete that surrounds a cavity defining the large garbage pit 4. Such furnace body that combines the zigzag blast furnace 10 and the accessory burning furnace 12 is built in a wide and flat configuration, so as to increase the burning area therein. The operation flow scheme of the tower of garbage incinerator comprises: a control room 5A responsible for controlling the operations of a crane 5, a grappler 6, a pushing lever 8, and a gate 9. When a garbage truck 1 enters the automatic door of the building, garbage carried therein is poured in a small garbage pit 3, while a crane 5 is used in combination with a grappler 6 to store a great amount of garbage in the large garbage pit 4. Water contained in the garbage can drain into a sewage collecting pool 18, and the spent heat radiated from the zigzag blast furnace 10 can be absorbed by the garbage in the large pit 4 to improve drying thereof. When operated, garbage in the large garbage pit 4 can be grappled by controlling the crane 5 and the grappler 6 and placed on the platform 7 in the front of the inlet at the top of the zigzag blast furnace 10. The temperature of 50°–65° C. at the inlet of the zigzag blast furnace 10 can accelerate the drying of the garbage. When the garbage is pushed into the blast furnace 10 by operating the pushing lever 8, the gate 9 that is normally closed, will open to feed garbage into the blast furnace 10 to be burned therein. When garbage enters the zigzag blast furnace 10, it will first pass through a high temperature drying zone 10A and drop along a zigzag pathway. The temperature in the furnace becomes higher as the garbage drops further, such that, as the garbage reaches a decomposition/burning zone 10B, most of the garbage has been decomposed or burned. When dropped further into the blast furnace, into the melting zone 10C, the garbage is largely converted into ashes or slags. Finally, the residue drops onto the movable furnace hearth 11 of the accessory burning furnace 12 and/or a hydraulic crushing pit 13 to be quenched, and subsequently carried by a slag removal conveyor to an ash storage pit K and transported to a landfill. Any residues that was incompletely burned that dropped through the zigzag blast furnace 10 onto the movable furnace hearth 11, will be burned slowly therein until it becomes completely burned. The heat generated in the accessory burning furnace 12 is used to further increase the temperature of gases entering the zigzag blast furnace 10.

The tower garbage incinerator is of a completely closed construction and is designed to be negatively pressurized such that odors will not leak therefrom. All of the air required for burning garbage within the furnace body is drawn from the suction inlet 21 above the big garbage pit 4. The air drawn therethrough contains odors from the garbage and flows downwardly along the furnace wall of the zigzag blast furnace via the air conduct 22 and is heated to a temperature higher than 100° C. Such odorous air is drawn by the blower 23 into the accessory burning furnace 12 and will be driven by the blower 23 through the bottom of the movable furnace hearth 11. The air flows upwardly and is burned to form a hot gas flow having a high temperature, enters the bottom of the zigzag blast furnace 10 and flows upwardly along the zigzag pathway, where, the hot gas flow H, shown in FIG. 2, burns vigorously with the garbage. The hot gases flow further upwardly through the melting zone 10C and the decomposition/burning zone 10B, where it is burned into waste gases still having a very high temperature. The hot gases will flow further upwardly into the high temperature drying zone 10A to dry and heat freshly dropped garbage to improve the burning efficieny thereof. Afterward, the whole gas stream will pass through the waste gas discharging outlet 14 at the top of the zigzag blast furnace 10, and enter a secondary burning room 15 where, under a high temperature of 1200° C. and a waste gas retention time 1–2 seconds, noxious gases such as carbon monooxide, carbon black and dioxin are removed therefrom. Then, the high temperature waste gas will enter a energy recovering boiler 15A, where the heat energy can be transformed into a desired energy source (such as kinetic energy or electric energy). The energy recovery boiler 15A also lowers the temperature of the waste gas. The waste gas will subsequently enter into waste gas-cleaning equipment 16 for neutralizing acidic gases, removing dust, and stripping to form a clean waste gas, and is finally drawn by a guiding blower 16A for discharge from a chimney 17.

Figure 2:
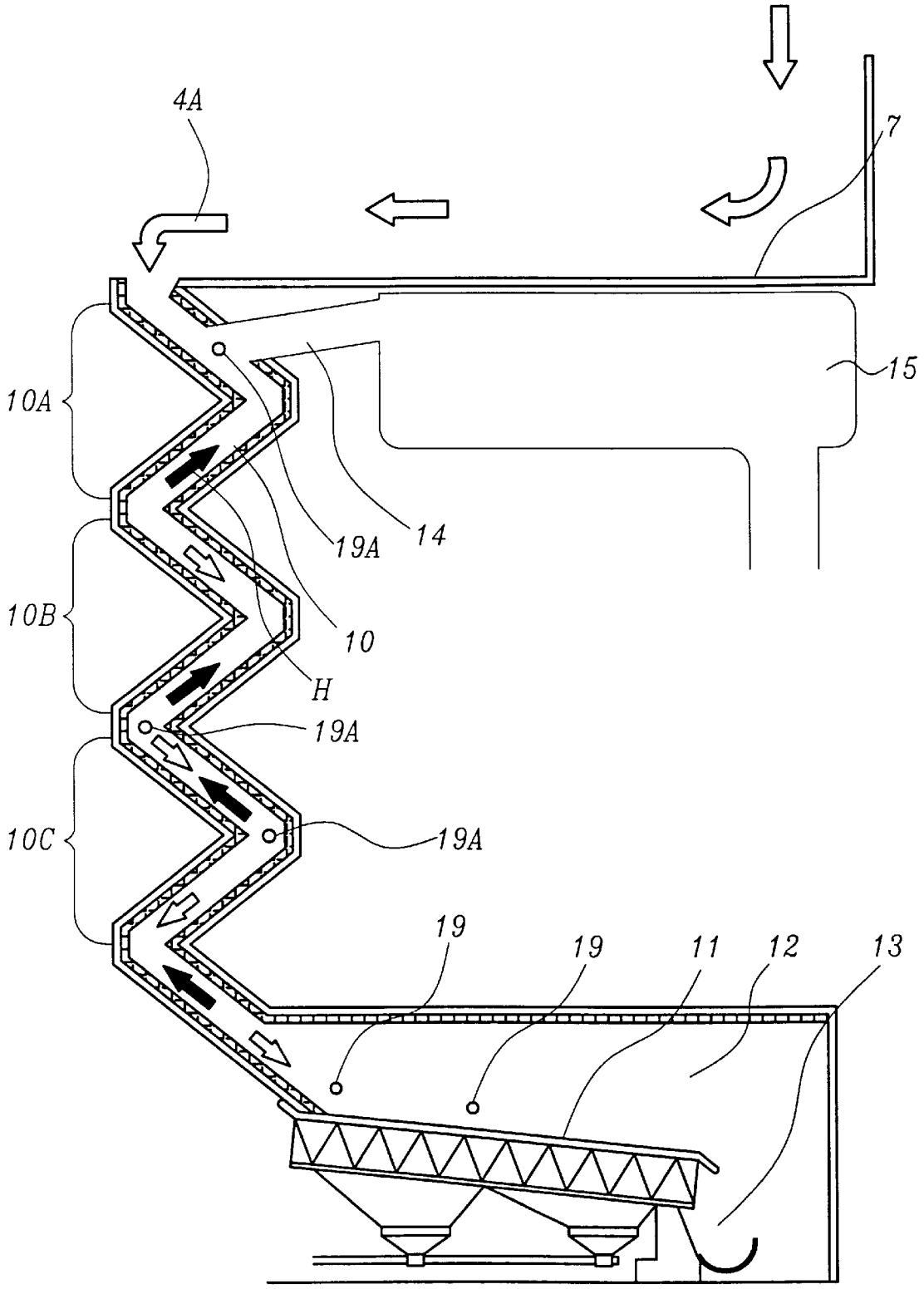
FIG. 2 shows the illustrative flow scheme for the incineration of garbage in the zigzag blast furnace of the tower garbage incinerator of the present invention.

Now, referring to FIG. 2, an illustrative flow scheme for the incineration of garbage in the zigzag blast furnace 10 comprises placing garbage on the platform 7 at the top of the blast furnace, where it can absorb the spent heat to increase the degree of drying of the garbage. In particular, the waste gas discharging outlet 14 is provided above the zigzag blast furnace 10 so that the spent heat can be utilized further to dry garbage by the high temperature thereof. Garbage that is sufficiently dried can have its heat value increased several times so that not only fuel can be saved, but also the heat energy generated by the fuel will be greater. Garbage 4A enters the zigzag blast furnace 10, passes through the high temperature drying zone 10A, drops in the area of the decomposition/burning zone 10B, and drops further in the hot portion of the blast furnace, the melting zone 10C, where most of the garbage will be sintered into a small amount of slag and ashes. Then the residue drops onto the movable furnace hearth 11 of the accessory burning furnace 12. The hot slag and some incompletely burned garbage that passed through the zigzag blast furnace 10, such as garbage that dropped rapidly and has a spherical shape, will be burned in the movable furnace hearth 11. The temperature in the accessory burning furnace is kept at 950±50° C. When the temperature is too low, the burner 19 is turned on to add heat, and when the temperature is too high, the liquid from the sewage collecting pool 18 can be sprayed therein to lower the temperature. As garbage 4A in the blast furnace 10 drops gradually, the hot gas H whirling upwardly not only slows down the dropping velocity of the garbage, but also stirs and disperses the garbage thoroughly, so that the burning area can be extended and the burning efficiency can be greatly improved. Waste gases discharged from the outlet 14 can be subjected to further cleaning treatments.

Figure 3:
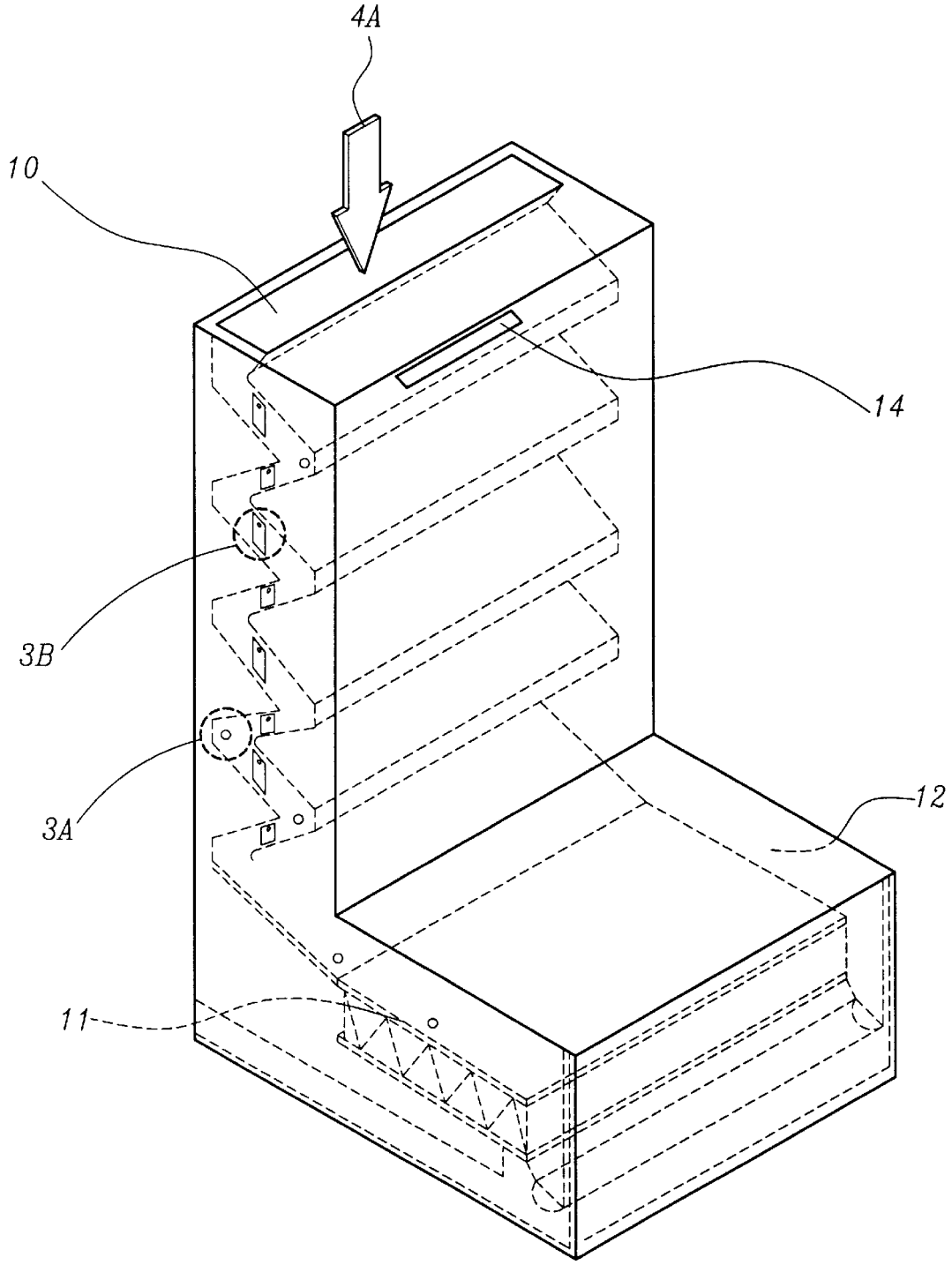
FIG. 3 shows a perspective view of one embodiment of the tower garbage incinerator of the present invention.
Figure 3A:
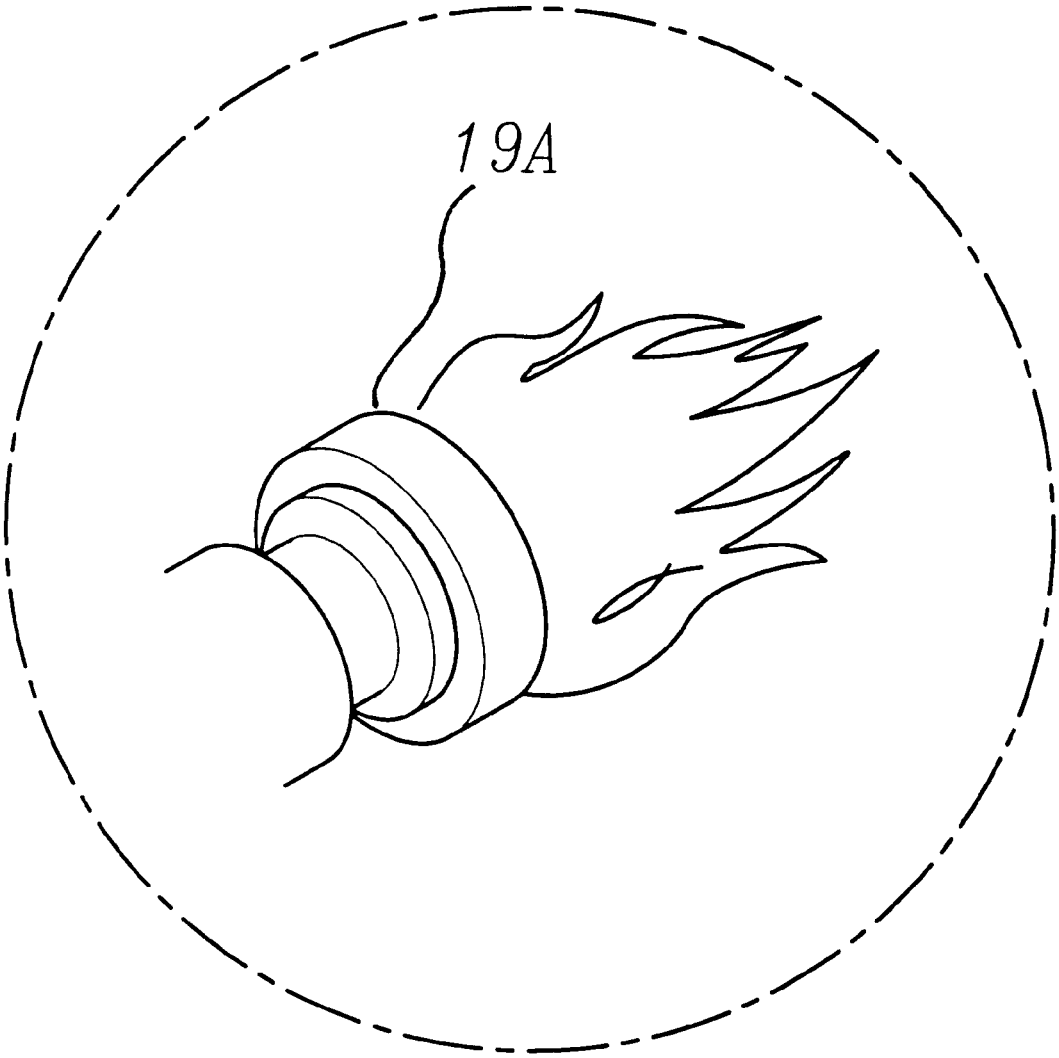
FIG. 3A is an enlarged elevational view of the burners shown in FIG. 3.
Figure 3B:
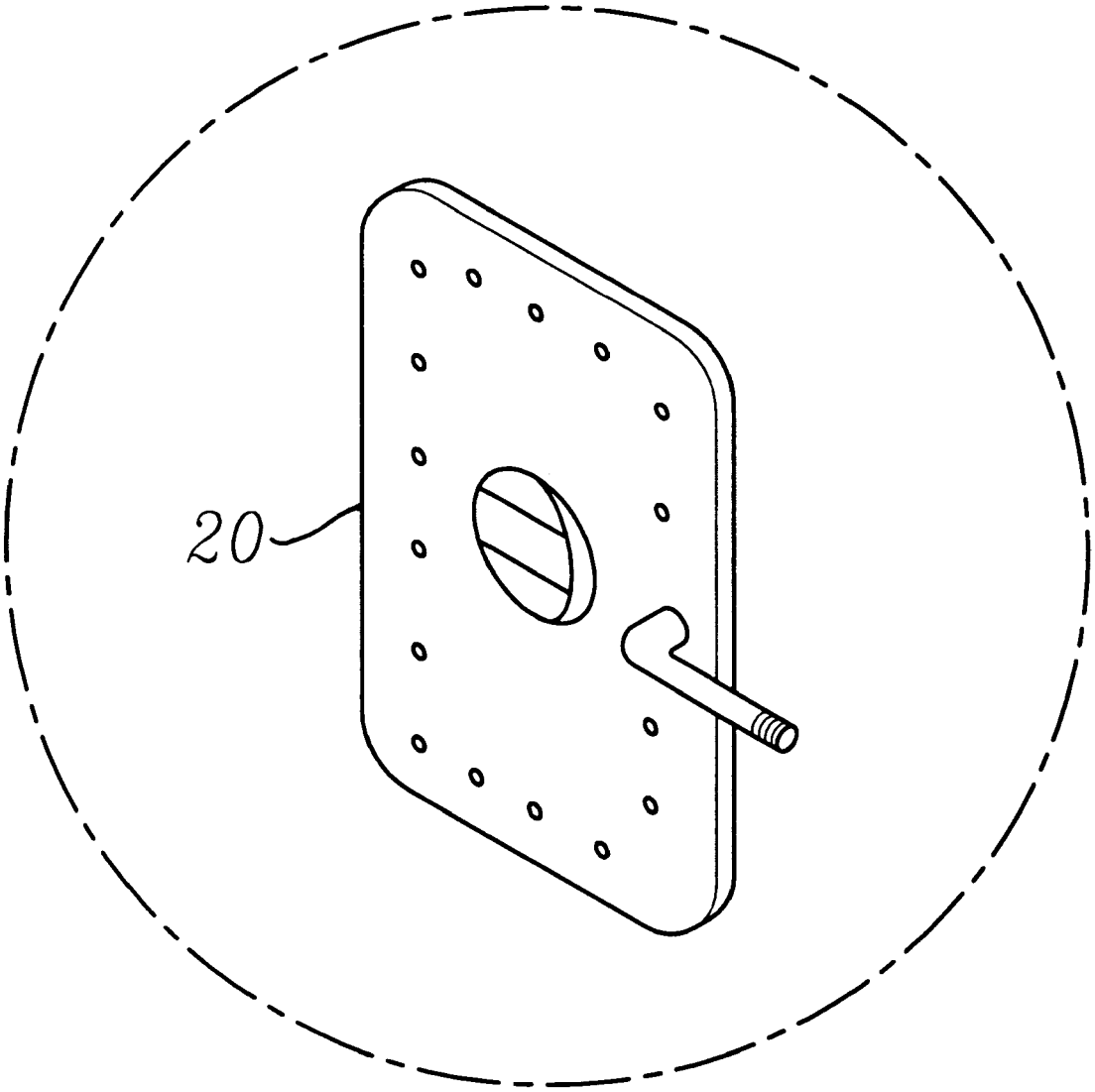
FIG. 3B is an enlarged perspective view of the hinge covers shown in FIG. 3.

Referring to FIG. 3, the perspective view of one embodiment of the tower garbage incinerator shows burners 19A provided in the zigzag blast furnace 10, which are used to keep the blast furnace 10 at a temperature of higher than 1000° C., and only at such temperature can the garbage 4A be fed into the incinerator for burning. In a case when the furnace has an insufficient temperature, flames can be injected from burners 19A (the burners can also be used as inject ports of waste oil or waste liquid). Alternatively, the zigzag blast furnace 10 can be provided a number of hinge covers 20 which are normally closed, and which can be used as inspection holes in case examination is necessary, or as leak-proof openings. Discharge outlet 14 is used to guide the waste gas to equipment for further cleaning.

Figure 4:
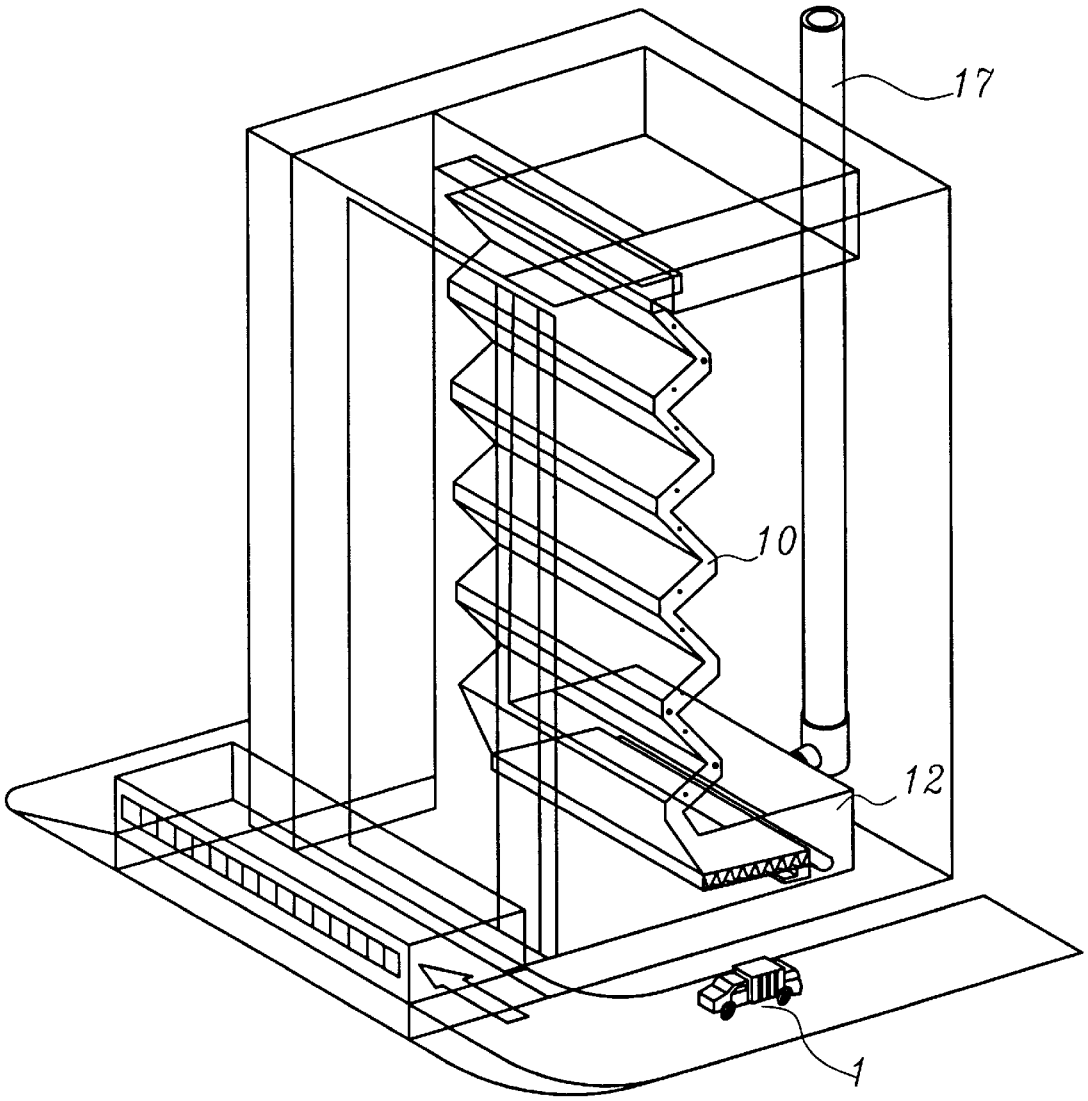
FIG. 4 is a schematic perspective view showing the outer and inner structure of the tower garbage incinerator of the present invention.

Now, referring to FIG. 4, there is shown the outer and inner structure of the tower garbage incinerator of the present invention with respect to the structure and construction morphology thereof.

The tower garbage incinerator is a high efficiency design that exerts the optimal utilization of space. It has a zigzag blast furnace having a wide and flat shape that takes of a small amount of land while exhibiting a large burning area. The whole space is designed for conveniently feeding the garbage into the blast furnace, and for storing a large amount of garbage. The construction of the outer and inner structure of the incinerator, as a closed tower, can not only protect the furnace body and prevent odors from escaping, but also has a magnificent appearance.

The most significant feature of the tower garbage incinerator is its small land requirement and large garbage treating capacity. In particular, the design of the zigzag blast furnace utilizes natural physical forces so that a high efficiency of complete burning can be achieved with only a very small amount of energy. In addition, the flow scheme of garbage treatment is simple, garbage does not need to be crushed and sorted, the maintenance of the incinerator is easy as there is little wear thereof, which makes it of very high economic value. Furthermore, the operational temperature of the zigzag blast furnace can be very high, and the slag produced is a nontoxic inorganic material of an amount less than 5% of the original amount of garbage. Such realizes a reduction in garbage and provides safety, and is an excellent approach for garbage treatment.

Many changes and modifications in the above described embodiment of the present inveniton can be carried out without departing from the scope therof. Accordingly, the invention is intended to be limited only by the scope of the appended claims.

What is claimed is:

1. A tower garbage incinerator, comprising:

an upper main blast furnace having a furnace cavity defining a zigzag pathway for garbage to pass therethrough, said upper main blast furnace having a garbage inlet and a waste gas outlet located at an upper end of said main blast furnace for heating and drying garbage with waste heat;

a lower furnace disposed beneath said upper main blast furnace in open communication with said zigzag pathway for burning unburnt residue from said upper main blast furnace and for increasing temperatures of gases supplied to said upper main blast furnace;

a garbage storage pit adjacent said upper main blast furnace and said lower furnace; and, means for supplying combustion air from said garbage storage pit to said lower furnace and said upper main blast furnace.

2. A tower garbage incinerator, comprising:

an upper main blast furnace having a furnace cavity defining a zigzag pathway for garbage to pass therethrough, said upper main blast furnace having a garbage inlet and a waste gas outlet located at an upper end of said main blast furnace for heating and drying garbage with waste heat;

a lower furnace disposed beneath said upper main blast furnace in open communication with said zigzag pathway for burning unburnt residue from said upper main blast furnace and for increasing temperatures of gases supplied to said upper main blast furnace; and, a garbage storage pit adjacent said upper main blast furnace and said lower furnace, said garbage storage pit being formed with concrete and steel rods.

3. A tower garbage incinerator, comprising:

an upper main blast furnace having a furnace cavity defining a zigzag pathway for garbage to pass therethrough, said furnace cavity having a plurality of openings formed therein, each of said openings having a respective hinged cover forming a closure therefore to provide access to said zigzag pathway for inspection and maintenance, said upper main blast furnace having a garbage inlet and a waste gas outlet located at an upper end of said main blast furnace;

a lower furnace disposed beneath said upper main blast furnace in open communication with said zigzag pathway for burning unburnt residue from said upper main blast furnace and for increasing temperatures of gases supplied to said upper main blast furnace; and, a garbage storage pit adjacent said upper main blast furnace and said lower furnace.

* * * * *